US005618200A

United States Patent [19]

Norgaard

[11] Patent Number: 5,618,200

[45] Date of Patent: Apr. 8, 1997

[54] ELECTRICAL CONNECTOR

[76] Inventor: Thomas W. Norgaard, c/Cumana Ota. #51 Clns del Tamanaco, Caracas, Venezuela

[21] Appl. No.: 467,850

[22] Filed: Jun. 6, 1995

[30] Foreign Application Priority Data

Mar. 16, 1995 [VE] Venezuela ..... 040595

[51] Int. Cl.[6] ..... H01R 4/24

[52] U.S. Cl. ..... 439/427; 439/428; 439/784; 174/85

[58] Field of Search ..... 439/427, 428, 439/429, 784; 174/84 R, 85

[56] References Cited

U.S. PATENT DOCUMENTS

| | | | |
|---|---|---|---|
| 457,865 | 8/1891 | Manson | 212/294 |
| 1,973,322 | 9/1934 | Staples | 439/784 |
| 3,156,762 | 11/1964 | Matthysse | 439/429 |
| 4,091,233 | 5/1978 | Berman | 439/427 |
| 4,454,376 | 6/1984 | Holder et al. | 439/784 |

*Primary Examiner*—P. Austin Bradley
*Assistant Examiner*—T. C. Patel
*Attorney, Agent, or Firm*—Head, Johnson & Kachigian

[57] ABSTRACT

A device for connecting wires. The device has two elements; an external element and an internal metal element. The external element is cylindrical and hollow. The external element has a central section with an outer surface that is hexagonal. The external element has an orifice at each end. Both orifices are sized into receive wires and have internal threads. The internal threads function to grip the insulation of the wires and draw the wires inside of the device to make contact with the internal metal element or contact. The internal metal element, or contact, is located inside the external element and is secured by an internal bearing surface. The internal element possesses sharp points for puncturing the insulation on filamentous wires that are inserted into the orifices of the device to complete electrical contact between the wires. Alternatively, the internal element has blunt ends for contacting solid wires.

8 Claims, 2 Drawing Sheets

ELECTRICAL CONNECTOR

BACKGROUND OF THE INVENTION

1. Field of the Invention

This invention relates to improvements in the connection of wires. The invention permits wires, which conduct electricity or other signals, to be connected without cutting, trimming, twisting or joining the wires. The resulting connection is efficient and safe.

2. Description of the Prior Art

Electrical connections or other types of connections are usually done in an elementary way, with excessive material, including conductors or insulation material. This is not convenient for the transmission of the signal or for the connection itself, because the connection generates heat and is subject to rapid deterioration which increases the risk of a short circuit.

The present invention is a device and process that eliminates all types of risk associated with handling and connecting wires. This is because of the simple procedure of introducing the wires into orifices in the device and rotating the device so that internal threads draw the wires into contact with an internal metal element to complete the connection. Conversely, by simply rotating the device in an opposite direction, the wires are disengaged from the internal metal element and expelled from the device by the internal threads.

SUMMARY OF THE INVENTION

The present invention provides an efficient, safe, and easy method of connecting wires for the transmission of electricity.

The device has two elements, an external element and an internal element or internal metal contact. The external element is cylindrical with a central section that has an external surface that is hexagonal. Two orifices are used to receive wires inside the device. The central hexagonal section is used to receive a wrench to rotate the device.

The interior of the external element is hollow and has oppositely threaded internal threads at each end. Preferably, the interior of the central hexagonal section has two bearing surfaces that form a triangular shaped recess around an interior perimeter of the central hexagonal section. The triangular shaped recess formed by the two bearing surfaces hold in place an internal metal contact.

The internal metal contact is placed inside the external element. The function of the internal contact is to transmit electricity from one wire to the other. The shape of the metal contact is cylindrical, with the central section being of a greater diameter, and shaped to fit the bearing surfaces. These surfaces hold the internal contact in place. In one embodiment, each end of the internal contact possesses a sharp point that easily penetrates wire insulation to make electrical contact with the wires. In another embodiment, each end of the internal metal contact has a flat surface for abutting the ends of a solid wire.

It will become readily apparent to those skilled in this art from the following detailed description, wherein there is shown and described only the preferred embodiment of the invention, simply by way of illustration of the best mode contemplated for carrying out the invention, that the invention is capable of modifications in various obvious respects, all without departing from the invention. Accordingly, the description should be regarded as illustrative in nature, and not as restrictive.

DETAILED DESCRIPTION OF THE PREFERRED EMBODIMENT

Figure 1:
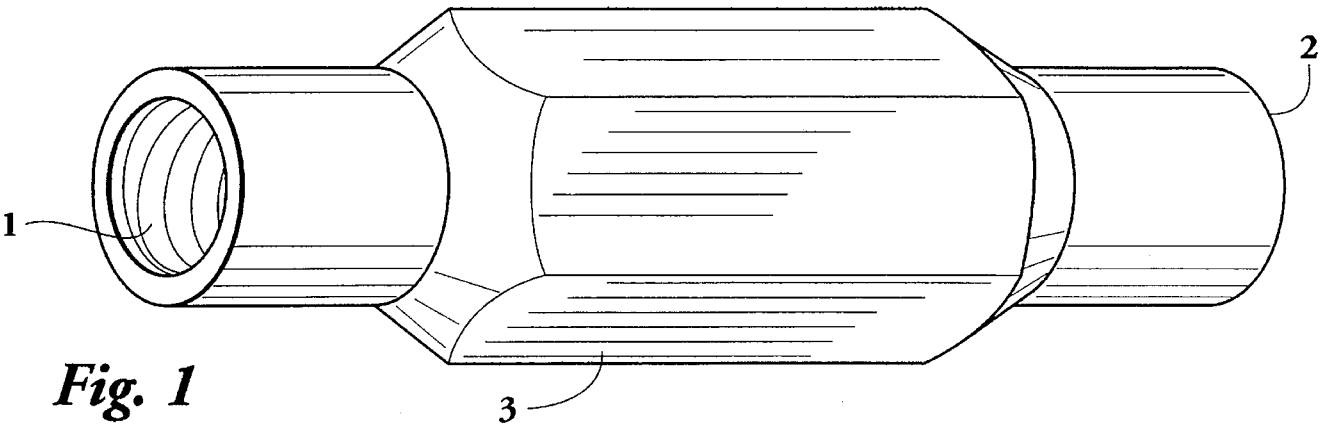
FIG. 1 is a perspective view of the device.

FIG. 1 shows orifices 1 and 2, and central section 3 of the external element. In practice, wires are pushed into orifices 1 and 2 until the wires engage internal threads 4 and 5 shown in FIG. 2. Central section 3 is used to receive a wrench for rotating the device so that the wires will be drawn toward the center of the device by the internal threads 4 and 5.

Figure 5:
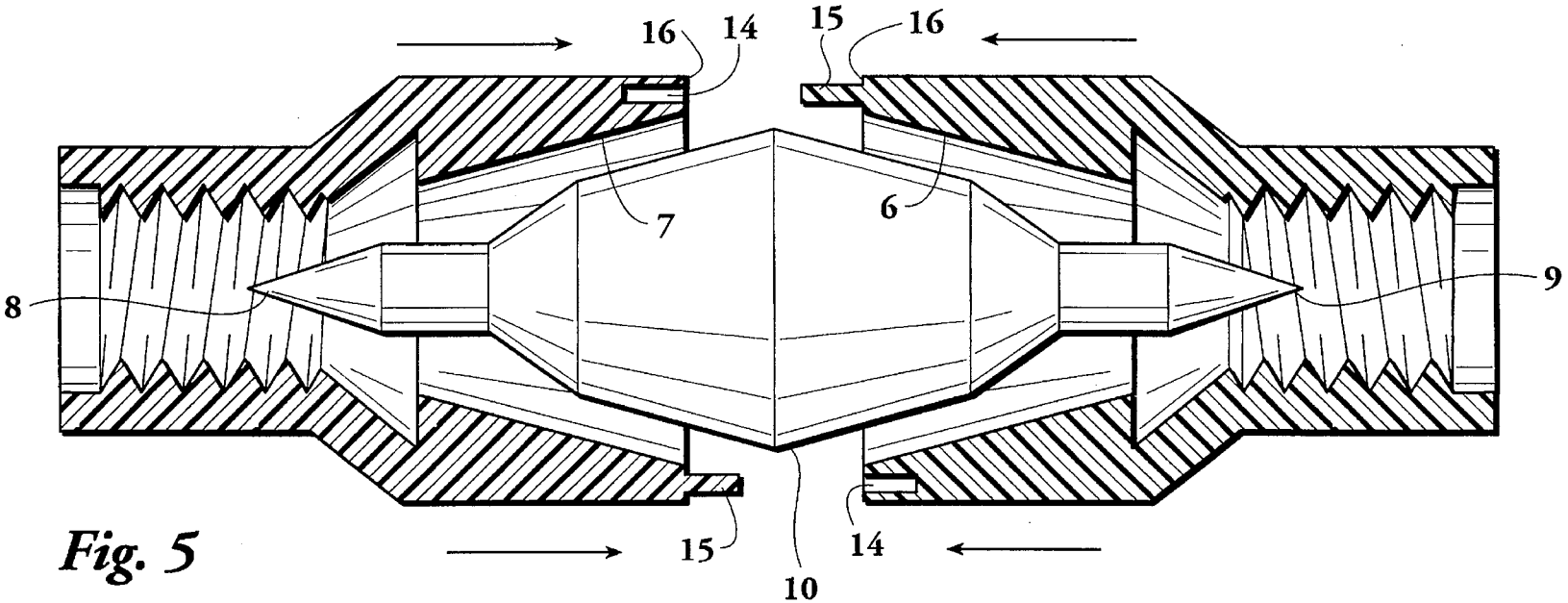
FIG. 5 is a cross section showing the structural components of the preferred external element and the internal contact.
Figure 2:
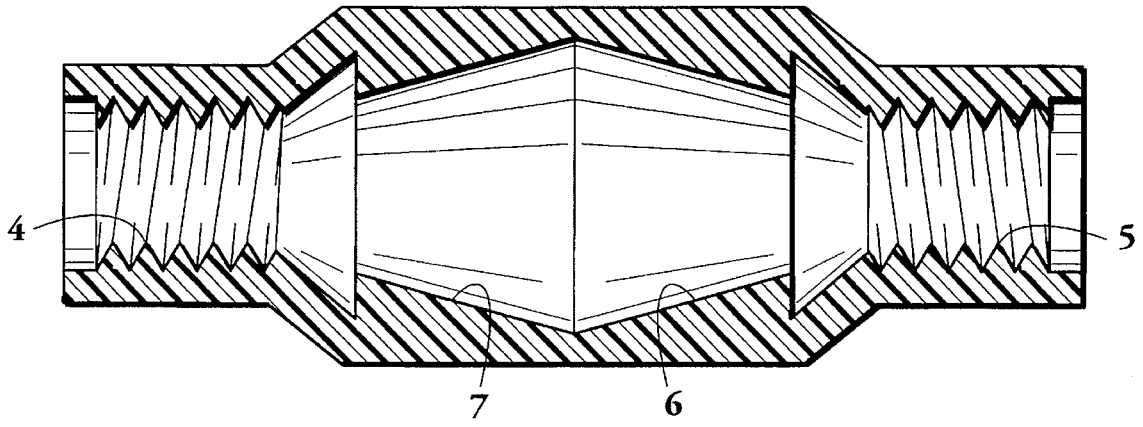
FIG. 2 is a partial cross-sectional view of the device.

FIG. 2 shows internal threads 4 and 5, and internal bearing surfaces 6 and 7. The internal threads 4 and 5 are oppositely threaded so that by rotating the external element, the wires in both ends are drawn toward central section 3 or are expelled from orifices 1 and 2, depending on the direction of rotation. Additionally, internal threads 4 and 5 closely engage the wires and insulate the wires and the interior of the connector from external factors. Bearing surfaces 6 and 7 function to tightly hold the internal contact inside the device. Bearing surfaces 6 and 7, internal threads 4 and 5, and the external element are preferably constructed of high resistance plastic. The external element is made in two separate pieces that are joined together to encompass the internal metal contact as shown in FIG. 5. Preferably, each piece of the external element has a pin receiving orifice 14 and a pin 15 fashioned on opposite sides of its mating surface 16. The pieces are aligned and pushed together. In addition to the pins 15 and orifices 14, ultrasonic energy may be applied to melt the two pieces together.

Figure 3:
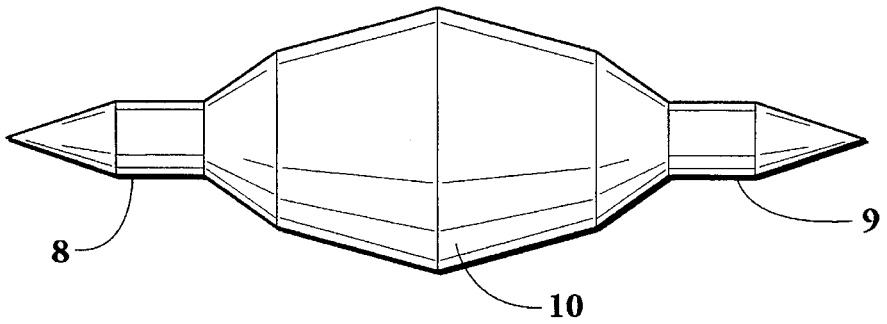
FIG. 3 is an elevational view of the internal contact.

FIG. 3 depicts the internal metal contact as used for flexible, or filamentous, wire. The internal metal contact is constructed of a highly conductive metal. The preferred material of construction is aluminum, although other material may be used. The internal metal contact is comprised of points of contact 8 and 9 and central section 10. The function of the internal metal contact is to be an electrical bridge between two wires. The sharp points of contact 8 and 9 at each end of the internal metal contact are used to penetrate insulation on the wires and make electrical contact therewith. The points of contact 8 and 9 facilitate a service connection by applying pressure in all directions on the insulation against the internal threads. The pressures work to insulate the contact and to hold the wires in place. Central section 10 is formed such as to hold the internal metal contact in place between bearing surfaces 6 and 7.

Figure 4:
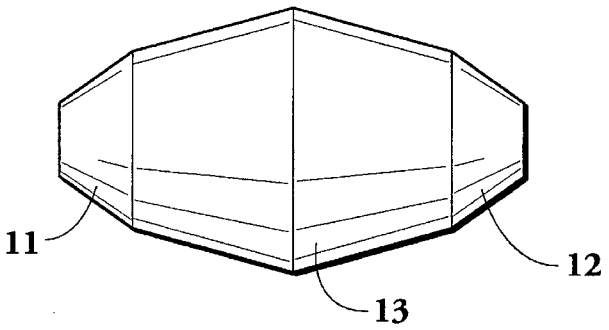
FIG. 4 is an elevational view of an alternate embodiment of the internal contact.

FIG. 4 depicts an alternate embodiment of the internal metal contact that is used for solid wire. In this embodiment, the internal metal contact is comprised of blunt contact surfaces 11 and 12. These surfaces abut the end of solid wire and make electrical contact therewith.

While the invention has been described with a certain degree of particularity, it is manifest that many changes may be made in the method hereinabove described without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A connector for wires that eliminates the need for cutting, trimming, twisting or using insulating tape, comprising:

(a) a tubular external element having two oppositely disposed non-tapered orifices and having a central section between said orifices, each of said orifices being adapted to receive an end of an insulated wire, an inside wall of said external element corresponding to said central section defining a hollow internal region; and (b) a separable internal contact having oppositely disposed contact surfaces, said internal contact seated within said internal region, said internal contact being adapted to electrically communicate with said insulated wire via said contact surfaces;

said external element being internally and oppositely threaded with a non-conductive thread about said orifices such that by rotating said external element said wire is drawn toward said internal contact without cutting said insulated wire and is retained in electrical communication therewith or expelled from said external element, depending on the direction of rotation.

2. A connector for wires as recited in claim 1, wherein said contact surface are blunt.

3. A connector for wires as recited in claim 1, wherein said external element is shaped to receive a wrench.

4. A connector for wires as recited in claim 1, wherein said external element is made of high resistance plastic.

5. A connector for wires as recited in claim 1, wherein said internal contact is constructed of aluminum.

6. A connector for wires as recited in claim 1, wherein said contact surfaces comprise sharp points.

7. A connector for wires as recited in claim 6, wherein said sharp points are conical.

8. A connector for wires that eliminates the need for cutting, trimming, twisting or using insulating tape, comprising:

(a) a tubular external element constructed of high resistance plastic having two oppositely disposed non-tapered orifices each adapted to receive an end of an insulated wire, said external element having a central section with a hexagonal-shaped exterior between said orifices, an inside wall corresponding to said central section having bearing surfaces and defining a hollow internal region; and (b) a separable internal contact constructed of a highly conductive metal having contact surfaces, said contact surfaces being oppositely facing and axially aligned with said orifices such as to electrically communicate with said insulated wire, said contact surfaces further comprising conical projections for penetrating said insulated wire to establish an insulated electrical communication therewith and to apply pressure to said insulated wire such as will hold said insulated wire in place against said orifices;

said external element being internally and oppositely threaded with a non-conductive thread about said orifices such that by rotating said external element said wire is drawn toward said internal contact without cutting said insulated wire and is retained in electrical communication therewith or expelled from said external element, depending on the direction of rotation.

* * * * *